US012781510B2

(12) United States Patent
Fox

(10) Patent No.: US 12,781,510 B2
(45) Date of Patent: Nov. 3, 2026

(54) METHOD OF USING FLUTED FURRING STRIP

(71) Applicant: FOX HARDWOOD LUMBER COMPANY, LLC, Franklin, TN (US)

(72) Inventor: Tommy Fox, Franklin, TN (US)

(73) Assignee: Fox Hardwood Company, LLC, Franklin, TN (US)

( * ) Notice: Subject to any disclaimer, the term of this patent is extended or adjusted under 35 U.S.C. 154(b) by 245 days.

(21) Appl. No.: 18/614,622

(22) Filed: Mar. 22, 2024

(65) Prior Publication Data

US 2024/0392577 A1 Nov. 28, 2024

Related U.S. Application Data

(60) Provisional application No. 63/468,665, filed on May 24, 2023.

(51) Int. Cl.
*E04F 13/08* (2006.01)

(52) U.S. Cl.
CPC ..... *E04F 13/0803* (2013.01)

(58) Field of Classification Search
CPC ..... E04F 13/0803
USPC ..... 52/747.1
See application file for complete search history.

(56) References Cited

U.S. PATENT DOCUMENTS 3,318,056 A * 5/1967 Thompson ..... E04B 2/709 52/603
5,761,864 A * 6/1998 Nonoshita ..... E04D 13/17 52/95
5,813,137 A * 9/1998 Townsend ..... B65G 1/14 248/346.02
6,134,803 A * 10/2000 Gilchrist ..... F26B 25/185 34/239
6,279,284 B1 * 8/2001 Moras ..... E04F 13/007 52/483.1
6,279,286 B1 * 8/2001 Ichihashi ..... E04F 13/0826 52/489.1
RE38,118 E 5/2003 Townsend
6,594,964 B2 * 7/2003 Charland ..... E04C 3/29 52/302.1
7,003,898 B2 * 2/2006 Aaron ..... F26B 25/185 34/518
7,926,199 B2 * 4/2011 Aaron ..... F26B 25/185 248/346.02

(Continued)

FOREIGN PATENT DOCUMENTS

CA 2156761 A1 11/1996

OTHER PUBLICATIONS

Air-O-Flow kiln sticks and blocks, DHM Company, Troy, Tennessee, 5 pp., download Apr. 17, 2023.

*Primary Examiner* — James J Buckle, Jr.
(74) *Attorney, Agent, or Firm* — Shane Cortesi

(57) ABSTRACT

Fluted furring strips and methods of using the same are described. In some embodiments, the present disclosure provides a method of connecting a substrate to a panel that comprises: a) providing a substrate; b) providing a fluted furring strip comprising a front and/or rear with a plurality of grooves separated by a plurality of ridges; c) providing a panel; and d) connecting the panel, the fluted furring strip, and the substrate so that the strip front faces the panel rear, and the strip rear faces the substrate front.

30 Claims, 14 Drawing Sheets

(56) References Cited

U.S. PATENT DOCUMENTS

| | | | | |
|---|---|---|---|---|
| 8,429,866 | B2 * | 4/2013 | Knight | E04B 2/58 52/506.03 |
| 9,856,655 | B2 * | 1/2018 | Knight | E04F 13/0862 |
| 10,234,203 | B2 | 3/2019 | Townsend | |
| 11,953,263 | B2 * | 4/2024 | Templeman | F26B 3/04 |
| 2001/0000875 | A1 | 5/2001 | Townsend | |
| 2003/0037499 | A1 * | 2/2003 | Coulton | E04B 1/7612 52/309.1 |
| 2006/0080939 | A1 * | 4/2006 | Bledsoe | E04F 13/16 52/750 |
| 2007/0220821 | A1 * | 9/2007 | Omiya | E04F 13/0862 52/391 |
| 2021/0371338 | A1 * | 12/2021 | Dones | C04B 28/02 |

* cited by examiner

METHOD OF USING FLUTED FURRING STRIP

BACKGROUND

Technical Field

The present invention relates to building materials for building homes and other structures.

Background of the Invention

Contemporary manufacturers aim to merge aesthetics and functionality in residential and commercial siding and other cladding products. However, inadequate airflow between the wall and cladding can cause moisture entrapment, leading to issues compromising the structural integrity, lifespan, and appearance of building materials, fasteners, and finishes.

Regardless of material or treatment, proper airflow and moisture management are vital for maintaining siding quality, durability, and stability. For vertical siding, one prevalent technique to enhance airflow is installing horizontal furring strips, but traditional strips obstruct ventilation. Horizontal siding, which generally uses vertical furring strips, could also benefit from increased cross ventilation and reduced pressure differential.

Current ventilation solutions utilize non-load-bearing materials, functioning only as spacers. Such spacer-type furring strips lack a suitable mounting substrate, necessitating cladding attachment to drainage plane materials like oriented strand board (OSB) or plywood, which are unsuitable due to poor fastener retention.

Innovative construction methods and materials are needed to improve siding attachment and boost airflow in siding-equipped structures, ensuring enduring protection and durability across various siding types and orientations.

SUMMARY OF THE INVENTION

The present disclosure provides fluted furring strips and methods of using the same. Without being bound by any particular theory, such furring strips may improve airflow and also be load-bearing.

In some embodiments, the present disclosure provides a method of connecting a substrate to a panel that may comprise one or more of the following steps: a) providing a substrate that may comprise a substrate front, a substrate rear, and a substrate thickness extending from the substrate front to the substrate rear; b) providing a fluted furring strip that may comprise a strip first end, a strip second end, a width extending from the strip first end to the strip second end, a strip front, a strip rear, a strip thickness extending from the strip front to the strip rear and perpendicular to the strip width, a strip proximal end, a strip distal end, and a strip length extending from the strip proximal end to the strip distal end and generally perpendicular to the strip thickness and the strip width, wherein the front and/or rear may comprise a plurality of grooves separated by a plurality of ridges, wherein the strip length may be greater than the strip width and strip thickness; c) providing a panel that may comprise a panel front, a panel rear, and a panel thickness extending from the panel front to the panel rear; and d) connecting the panel, the fluted furring strip, and the substrate so that the strip front faces the panel rear, and the strip rear faces the substrate front.

Optionally, step d) comprises attaching the panel to the fluted furring strip and the fluted furring strip to the substrate using one or more fasteners. Optionally, the fastener comprises a screw, nail, bolt, and/or washer. Optionally, the fastener is oriented parallel to the strip thickness. Optionally, the method further comprises providing a backing comprising a backing front, a backing rear, and a backing thickness extending from the backing front to the backing rear. Optionally, step d) comprises connecting the panel, the fluted furring strip, the backing and the substrate so that the strip front faces the panel rear and the strip rear faces the substrate front and the backing front and so that the backing front faces the strip rear and the backing rear faces the substrate front. Optionally, the backing thickness is less than the strip thickness. Optionally, the backing comprises plywood or oriented strand board. Optionally, the substrate, fluted furring strip, and/or panel are comprised of wood. Optionally, the panel comprises a siding or other cladding panel. Optionally, the substrate comprises a post attached directly or indirectly to the ground. Optionally, the post comprises a stud. Optionally, the panel and the stud are oriented perpendicular to the fluted furring strip. Optionally, the stud is oriented perpendicular to the ground and the fluted furring strip is oriented parallel to the ground. Optionally, at least some of the ridges and grooves extend across the entire width of the fluted furring strip. Optionally, the strip front and strip rear comprise said plurality of grooves and said plurality of ridges. Optionally, the strip front and strip rear comprise the same pattern of ridges and grooves. Optionally, each adjacent groove is separated by a ridge. Optionally, each ridge comprises a rounded apex. Optionally, each groove is concave in shape. Optionally, the grooves are spaced approximately evenly apart along the strip length and the ridges are spaced approximately evenly apart along the strip length. Optionally, each groove is substantially the same size. Optionally, each ridge is substantially the same size. Optionally, the strip front and strip rear comprise said plurality of grooves and said plurality of ridges. Optionally, each groove on the strip front and strip rear is oriented diagonal to the strip length. Optionally, the grooves on the strip front are oriented parallel to each other. Optionally, the grooves on the strip rear are oriented parallel to each other. Optionally, the grooves on the strip rear are in a reverse orientation as compared to the grooves on the strip front. Optionally, the grooves on the strip rear are oriented parallel to the grooves on the strip front. Optionally, the strip first end and the strip second end are flat. Optionally, the strip length is between four feet and about twenty feet. Optionally, the strip thickness is between about 0.5 inches and about 2 inches. Optionally, the strip width is between about 1.5 inches and about 4 inches. Optionally, the strip width is greater than the strip thickness. Optionally, the strip proximal end and strip distal end comprise two flat regions separated by a groove extending parallel to the strip thickness. Optionally, said groove extending parallel to the strip thickness is concave. Optionally, said groove extending parallel to the strip width extends the entire strip width. Optionally, the method further comprises flowing air through the grooves.

In still further embodiments, the present disclosure provides a furring strip comprising one or more features described herein.

In still further embodiments, the present disclosure provides a method of connecting a substrate to siding or other cladding to form a wall that may comprise one or more of the following steps: a) providing a plurality of substrates, each substrate optionally comprising a substrate front, a substrate rear, and a substrate thickness extending from the substrate front to the substrate rear; b) providing a plurality of fluted furring strips, each fluted furring strip optionally, comprising a strip first end, a strip second end, a strip width extending from the strip first end to the strip second end, a strip front, a strip rear, a strip thickness extending from the strip front to the strip rear and perpendicular to the strip width, a strip proximal end, a strip distal end, and a strip length extending from the proximal end to the distal end and generally perpendicular to the strip thickness and strip width, wherein the strip front and/or strip rear may comprise a plurality of grooves separated by a plurality of ridges, wherein the strip length may be greater than the strip width and strip thickness; c) providing a plurality of panels, each panel optionally comprising a panel front, a panel rear, and a panel thickness extending from the panel front to the panel rear; and d) connecting the panels, the fluted furring strips, and the substrates, so that, after step d), the wall is comprised of a panel layer comprising the plurality of panels spaced at approximately equal intervals, a strip layer located behind the panel layer and comprising the plurality of fluted furring strips spaced at approximately equal intervals, and a substrate layer located behind the strip layer and comprising the plurality of substrates spaced at approximately equal intervals.

Optionally, the strip layer comprises at least four fluted furring strips spaced at approximately equal intervals. Optionally, the panel layer comprises at least four panels spaced no more than 2 inches apart. Optionally, the plurality of substrates comprise a plurality of studs and the substrate layer comprises at least four studs spaced at approximately equal intervals. Optionally, the distance between adjacent panels is less than the distance between adjacent fluted furring strips and adjacent substrates. Optionally, the method comprises providing a backing. Optionally, the method further comprises connecting the panels, the fluted furring strips, the backing, and the substrates so that, after step d), the wall is comprised of a panel layer comprising the plurality of panels spaced at approximately equal intervals, a strip layer located behind the panel layer and comprising the plurality of fluted furring strips spaced at approximately equal intervals, a backing layer located behind the strip layer and comprising the backing, and a substrate layer located behind the backing layer and comprising the plurality of substrates spaced at approximately equal intervals. Optionally, the panels are oriented vertically or horizontally, the strips are oriented vertically or horizontally, and the substrates are oriented vertically or horizontally.

In still further embodiments, the present disclosure provides a method of increasing airflow in siding or other cladding that may comprise one or more of the following steps: a)

providing a fluted furring strip comprising a plurality of grooves separated by a plurality of ridges; b) providing siding or other cladding; c) providing a post or beam; d) providing OSB, plywood or other backing; and e) connecting the siding or other cladding, fluted furring strip, post or beam and OSB, plywood or other backing with one or more fasteners so that the fluted furring strip is between and attached to the siding or other cladding and the OSB, plywood or other backing, and the OSB, plywood or other backing is between and attached to the fluted furring strip and the post or beam.

BRIEF DESCRIPTION OF THE DRAWINGS

in FIG. 17C, the grooves on the strip rear (which are not visible from the front) are shown in dashed lines to show how they are angled in a reverse orientation as compared to the grooves on the strip front.

in FIG. 17D, the grooves on the strip front (which are not visible from the rear) are shown in dashed lines to show how they are angled in a reverse orientation as compared to the grooves on the strip rear.

in FIG. 19C, the grooves on the strip rear (which are not visible from the front) are shown in dashed lines to show how they are angled in a reverse orientation as compared to the grooves on the strip front.

in FIG. 19D, the grooves on the strip front (which are not visible from the rear) are shown in dashed lines to show how they are angled in a reverse orientation as compared to the grooves on the strip rear.

in FIG. 20C, the grooves on the strip rear (which are not visible from the front) are shown in dashed lines to show how they are angled in a reverse orientation as compared to the grooves on the strip front.

in FIG. 20D, the grooves on the strip front (which are not visible from the rear) are shown in dashed lines to show how they are angled in a reverse orientation as compared to the grooves on the strip rear.

in FIG. 21C, the grooves on the strip rear (which are not visible from the front) are shown in dashed lines to show how they are angled in a reverse orientation as compared to the grooves on the strip front.

in FIG. 21D, the grooves on the strip front (which are not visible from the rear) are shown in dashed lines to show how they are angled in a reverse orientation as compared to the grooves on the strip rear.

DETAILED DESCRIPTION

Figure 1:
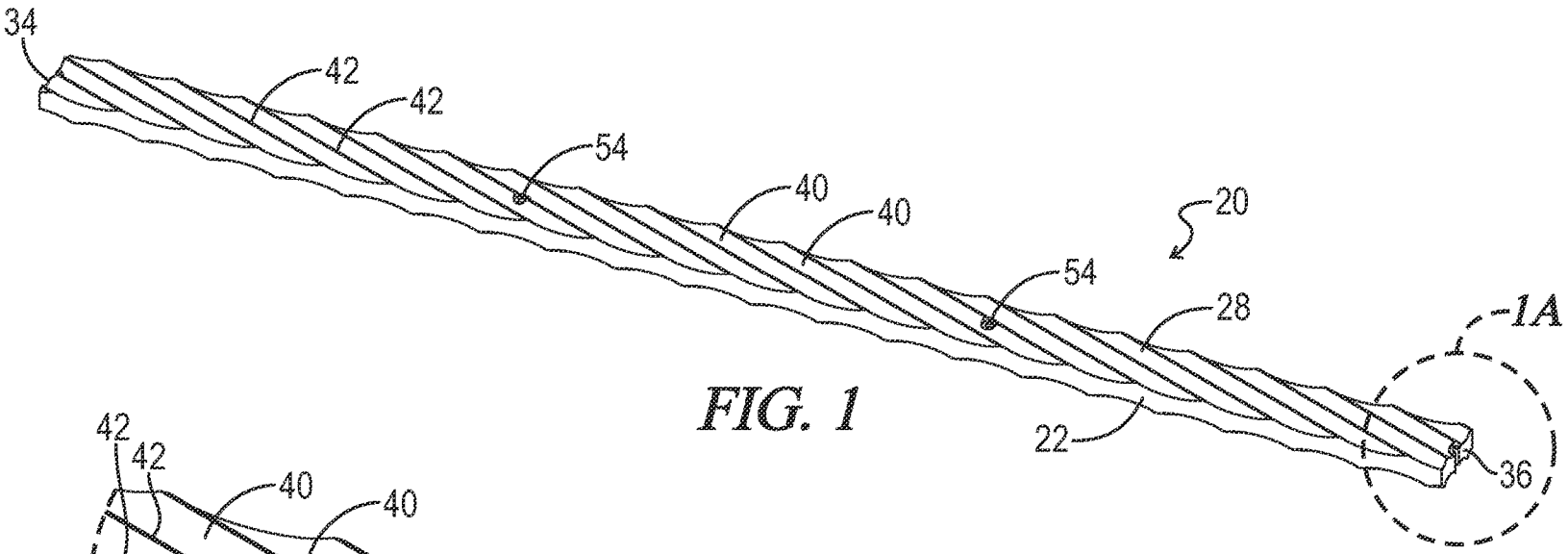
FIG. 1 illustrates a front, first end perspective view of a fluted furring strip in accordance with one embodiment of the present invention.

With reference to FIGS. 1-21, the present disclosure provides a fluted furring strip and use of the same. In the drawings, not all reference numbers are included in each of the drawings for the sake of clarity. FIGS. 1-21 are CAD drawings drawn to scale, however, it will be appreciated that other dimensions are possible.

Referring further to FIGS. 10-14, for example, in some embodiments, the present disclosure provides a method of connecting a substrate 10 to siding or other cladding, which may involve one or more of the following steps: a) providing a substrate 10 that may comprise a substrate front 14, a substrate rear 16, and a substrate thickness 18 extending from the substrate front 14 to the substrate rear 16; b) providing a fluted furring strip 20 that may comprise a strip first end 22, a strip second end 24, a width 26 extending from the strip first end 22 to the strip second end 24, a strip front 28, a strip rear 30, a strip thickness 32 extending from the strip front 28 to the strip rear 30 and perpendicular to the strip width 26, a strip proximal end 34, a strip distal end 36, and a strip length 38 extending from the strip proximal end 34 to the strip distal end 36 and generally perpendicular to the strip thickness 32 and the strip width 26, c) providing a panel 12 that may comprise a panel front 46, a panel rear 48, and a panel thickness 50 extending from the panel front 46 to the panel rear 48; and d) attaching the panel 12 indirectly to the substrate 10, by, for example, connecting the panel 12, the fluted furring strip 20 and the substrate 10 using one or more fasteners 52.

The panel 12, the fluted furring strip 20 and the substrate 10 may be connected by any suitable method. For example, in some embodiments, as shown in FIGS. 10-14, the method further comprises providing a backing 11 that may have a backing front 13, a backing rear 15, and a backing thickness 17 extending from the backing front 13 to the backing rear 15. Optionally the backing 11 is oriented strand board (OSB) or plywood or other sheathing material. While the backing 11 is shown as a single sheet, the backing 11 could also be a plurality of sheets/panels. Preferably, the backing 11 thickness 17 is from about 0.25 inches to about 0.75 inches. Because the backing 11 can be relatively weak and thin, in a preferred embodiment, a first set of screws or other fasteners 52 may extend through backing thickness 17 to attach the strip 20 to the substrate 10—e.g., the screw 52 may extend from the strip front 28, through the strip rear 30, through the backing front 13, through the backing rear 15 and into the substrate front 14 or alternatively from the substrate side first (e.g., from the substrate rear 16, through the substrate front 14, through the backing rear 15, through the backing front 13, and into the strip rear 30). Because the fluted furring strip 20 may be comparatively thicker and/or made of sturdier materials than the backing 11, the panel 20 may be attached directly to the fluted furring strip using a different fastener 52.

In the illustrated embodiments, the fluted furring strips 20 include pre-drilled fastener holes 54 that receive the fasteners 52, however, such pre-drilled fastener holes are merely optional.

Optionally, the front and/or rear 28/30 comprise a plurality of grooves/notches 40 separated by a plurality of ridges 42 to aid in ventilation. Optionally, the strip length 38 is greater than the strip width 26 and strip thickness 32. Optionally, the strip width 26 is greater than the strip thickness 32.

Optionally, the method further comprises flowing air through the grooves 40.

In some embodiments, the fluted furring strips 20 resemble lumber separators but have increased mass so that they can be load bearing. Lumber separators, also called drying sticks, are used for drying stacks of lumber and include a series of grooves between ridges to maximize air flow and hence expedite drying. Examples of drying sticks are described in, for example, U.S. Pat. No. 10,234,203, and U.S. Patent Publication 2001/0000875. Additionally, such separators are sold by, for example, Breeze Dried, Inc., Ontario, Canada and DHM of Troy, Tennessee, which produces a product called Air-O-Flow kiln sticks that provide air flow between the kiln stick and the lumber surface. However, such separators are not designed to be load bearing, do not attach to the stacks, and do not connect any materials.

In some embodiments, as shown in FIGS. 10-14, the substrate 10 may be attached directly or indirectly to the ground.

Any suitable orientation of the components can be employed and directional terms such as "front" and "rear" should be understood in their broadest sense. For example, if the components are used in a roofing structure and are layered parallel to the ground on top of each other, as viewed from above, the panel 12 could be located in front (on top of) the strip 20, which would be in front of (on top of) the substrate 10. Alternatively, if the components are used in a ceiling structure, and are layered parallel to the ground on top of each other, as viewed from below, the panel 12 could be located in front (below) the strip 20, which would be in front of (below) the substrate 10. Accordingly, "front" and "rear" can embrace a variety of orientations. In some preferred embodiments, the panel 12 is the component facing the viewer, and the strips 20 are hidden in view from the viewer (by the panel 12).

Optionally, as shown in FIGS. 10-14, the panel 12 and/or the substrate 10 are oriented perpendicular to the fluted furring strip 20. (In other words, the longest dimensions of each are perpendicular to each other). Optionally, as shown in FIGS. 10-14, the substrate 10 is oriented perpendicular to the ground and the fluted furring strip 20 is oriented parallel to the ground. Optionally, the panel 12 is oriented parallel or perpendicular to the ground.

Optionally, as shown in FIGS. 10-14, a plurality of substrates 10, fluted furring strips 20 and panels 12 (with or without a backing 11) are assembled together to form a wall 60. In such wall 60, any suitable arrangement may be used. For example, the wall 60 may be comprised of a panel layer comprised of a plurality of panels 12 that may be oriented horizontally or vertically (i.e., with their longest dimension extending horizontally vertically) and spaced approximately evenly apart, a strip layer comprised of a plurality of fluted furring strips 20 spaced approximately evenly apart, and a substrate layer comprising a plurality of substrates 10 and spaced approximately evenly apart. Optionally, the strip layer is located behind the panel layer, and the substrate layer is located behind the strip layer, and, if included, the backing is located between the strip layer and the substrate layer. Again, the components may be oriented in any suitable orientation. For example, the panels 12 may be oriented horizontally or vertically, and the fluted furring strips 20 may be oriented perpendicular to the panels 12. Optionally, the substrate 10 is oriented vertically or horizontally. Optionally, the strip layer comprises at least four fluted furring strips 20 spaced at approximately equal intervals. Optionally, the panel layer comprises at least four panels 12 spaced no more than 2 inches apart. Optionally, the substrate layer comprises at least four studs 10 spaced at approximately equal intervals. Optionally, the distance between adjacent panels 12 is less than the distance between adjacent fluted furring strips 20 and adjacent substrates 10. (In other words, optionally, the panels 12 are closer together than the substrates 10 and fluted furring strips 20).

Optionally, the substrate 10, fluted furring strip 20, and/or panel 12 are comprised of wood. Preferably, all three materials are comprised of wood. Alternatively, the fluted furring strip 20 may be comprised of other materials such as fiberglass. In some embodiment, the panel 12 is a siding panel. Optionally, the substrate 10 is, for example, a stud or other post, sill, plate, fire blocking, beam, and the like.

Optionally, as seen in FIGS. 1-9, at least some of the ridges 42 and grooves 40 extend across the entire width of the fluted furring strip 20 (e.g., all grooves 40 and ridges 42 except those on the proximal and distal ends 34 and 36). Optionally, as seen in FIGS. 1-9, both the strip front 28 and the strip rear 30 comprise said plurality of grooves 40 and said plurality of ridges 42. Optionally, as seen in FIGS. 1-9, the strip front 28 comprises the same pattern of ridges 42 and grooves 40 as the strip rear 30. Optionally, as seen in FIGS. 1-9, each adjacent groove 40 is separated by a ridge 42. Optionally, as seen in FIGS. 1-9, each ridge 42 comprises a rounded apex.

Optionally, as seen in FIGS. 1-9, for example, the grooves 40 are spaced approximately evenly apart along the strip length 38 and the ridges 42 are spaced approximately evenly apart along the strip length 38. Optionally, as seen in FIGS. 1-9, each groove 40 is substantially the same size. Optionally, as seen in FIGS. 1-9, each ridge 42 is substantially the same size. Optionally, as seen in FIGS. 1-9, each groove 40 is oriented diagonal to the strip length 38 and the grooves 40 are oriented parallel to each other. For example, with reference to FIG. 7, in some embodiments, the grooves 40 are oriented at an angle (reference numeral 62) of between, for example, about 30 and 90 degrees relative to the strip length 38. Optionally, as seen in FIGS. 1-9, the strip first and second ends 22 and 24 are flat. Optionally the strip length 38 is between about four feet and about twenty feet, the strip thickness 32 is between about 0.5 and about 2 inches, and the strip width 26 is between about 1.5 inches and about 4 inches. Optionally, the strip length 38 is at least five-fold (e.g., five to fifty fold) greater than the strip width 26 and strip thickness 32.

Figure 1A:
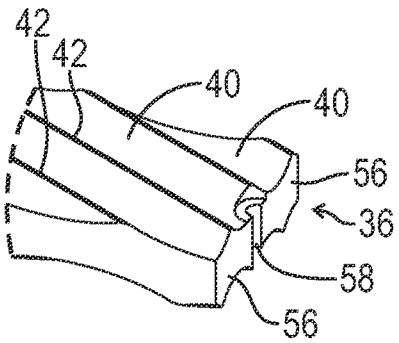
FIG. 1A illustrates a closeup view of the circled area labelled 1A in FIG. 1.
Figure 2:
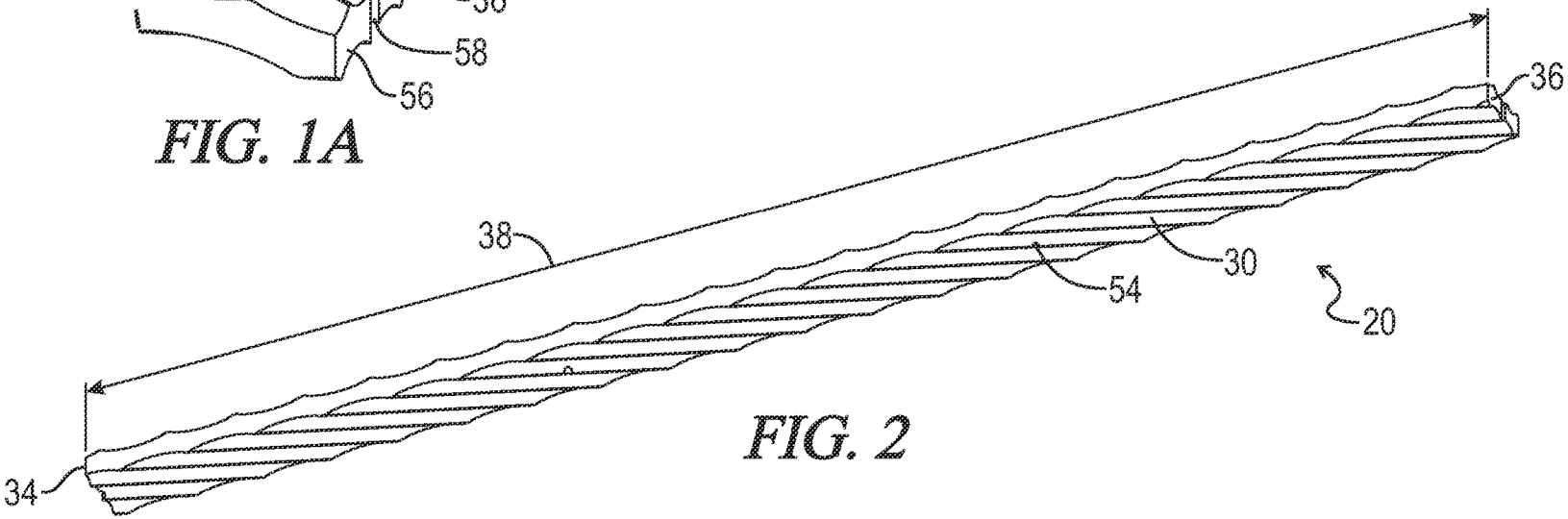
FIG. 2 illustrates a rear, first end perspective view of the fluted furring strip of FIG. 1.
Figure 3:
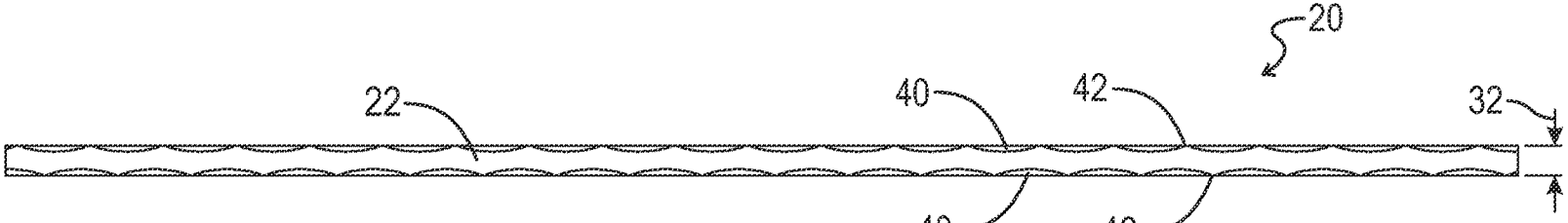
FIG. 3 illustrates a first end plan view of the fluted furring strip of FIG. 1.
Figure 4:
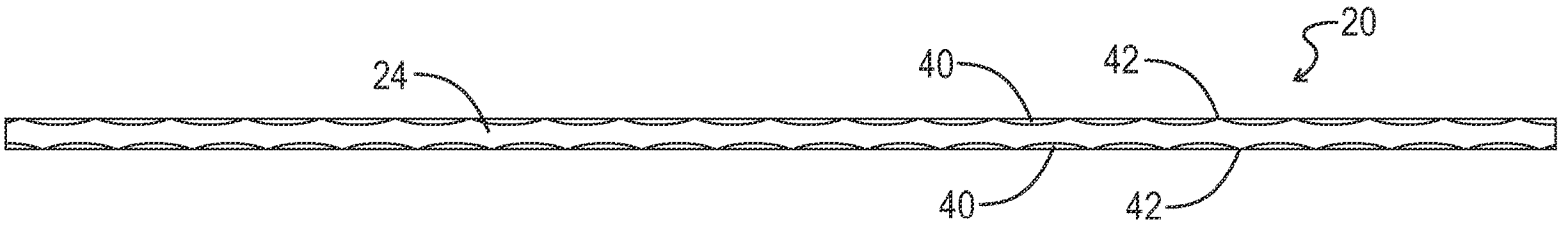
FIG. 4 illustrates a second end plan view of the fluted furring strip of FIG. 1.
Figure 5:
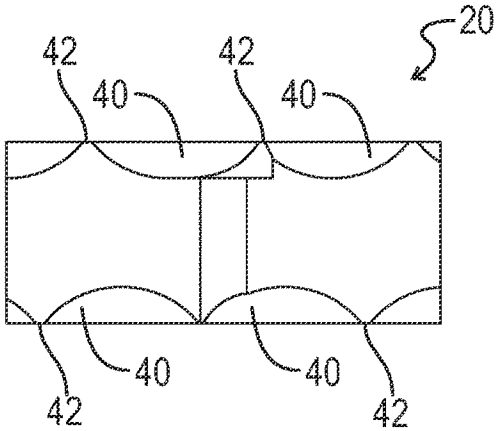
FIG. 5 illustrates a proximal end elevation view of the fluted furring strip of FIG. 1.
Figure 6:
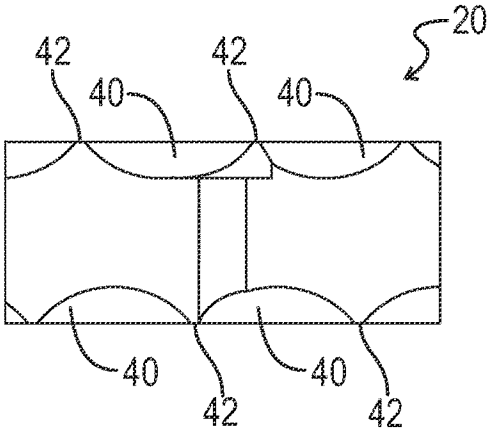
FIG. 6 illustrates a distal end elevation view of the fluted furring strip of FIG. 1.
Figure 7:
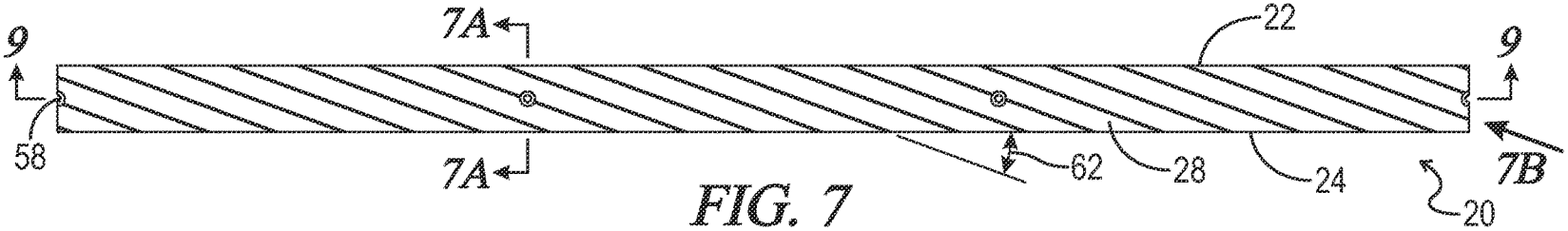
FIG. 7 illustrates a front elevation view of the fluted furring strip of FIG. 1.
Figure 7B:
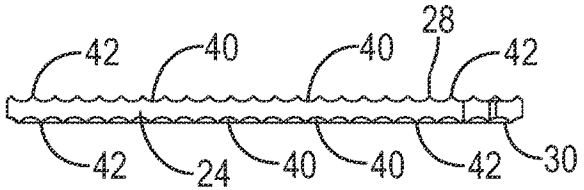
FIG. 7B illustrates a view of the fluted furring strip of FIG. 7, taken from directional arrow 7B of FIG. 7.
Figure 7A:
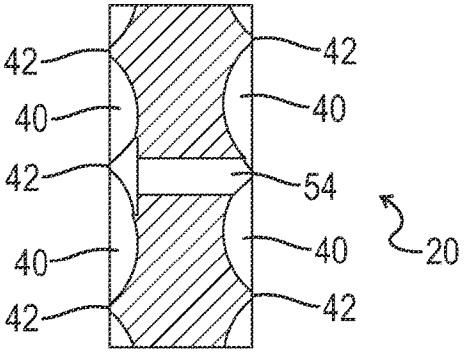
FIG. 7A illustrates a sectional view of the fluted furring strip of FIG. 7, taken along line 7A-7A of FIG. 7.
Figure 8:
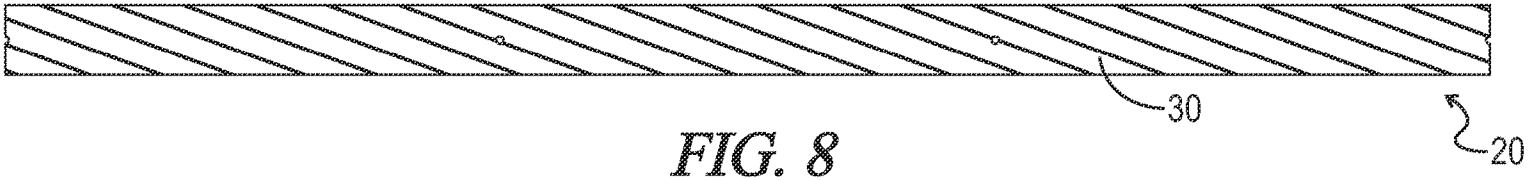
FIG. 8 illustrates a rear elevation view of the fluted furring strip of FIG. 1.
Figure 9:
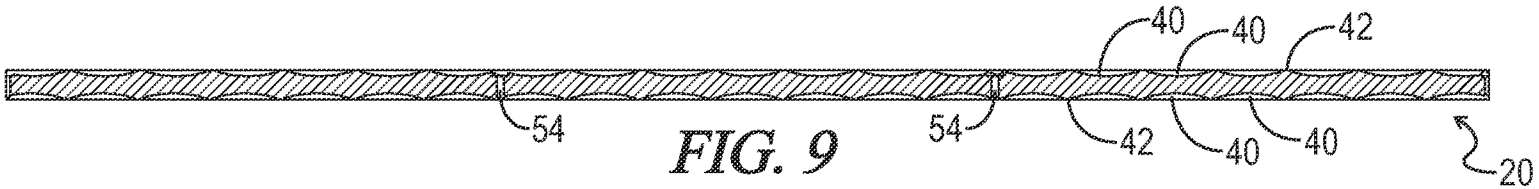
FIG. 9 illustrates a sectional view of the fluted furring strip of FIG. 7, taken along line 9-9 of FIG. 7.
Figure 10:
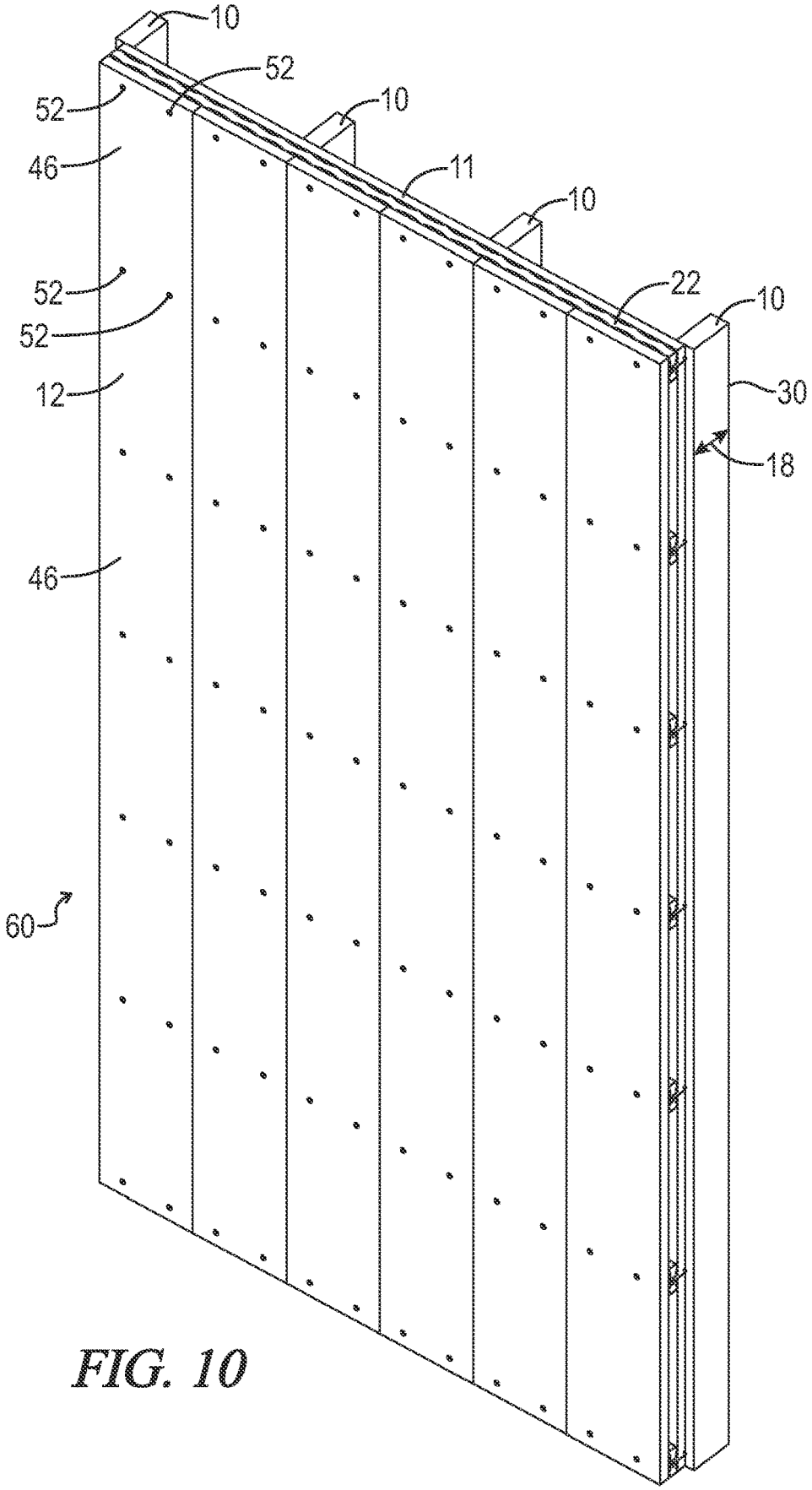
FIG. 10 illustrates a first end, front, distal end perspective view of a wall comprised of a panel layer comprised of vertical siding panels, a strip layer comprised of fluted furring strips extending across the rear of the vertical siding panels and a substrate layer comprised of studs extending vertically across the rear of the fluted furring strips.
Figure 11:
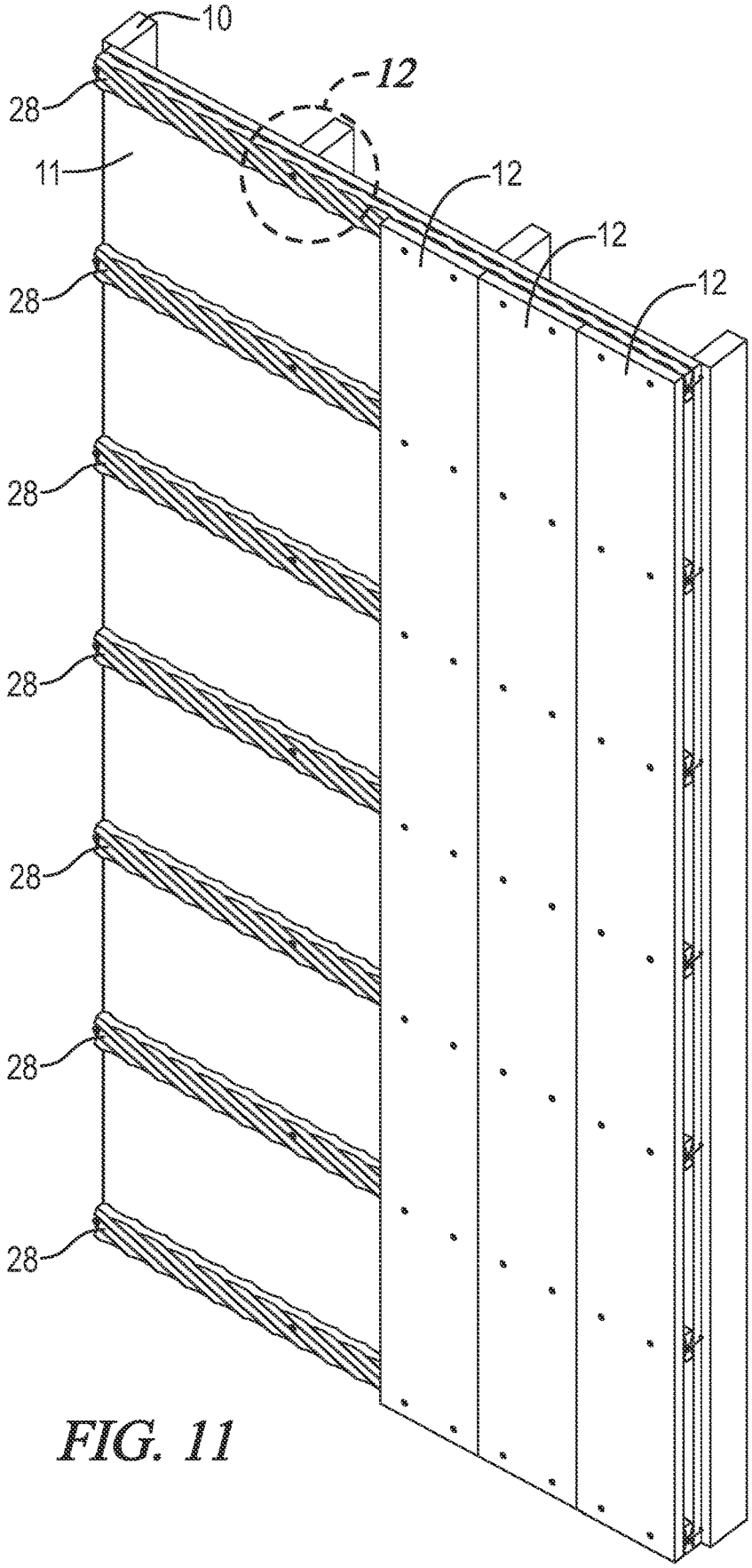
FIG. 11 illustrates a first end, front distal end perspective view of the wall of FIG. 10 with some of the vertical siding panels removed to better show the fluted furring strips.
Figure 12:
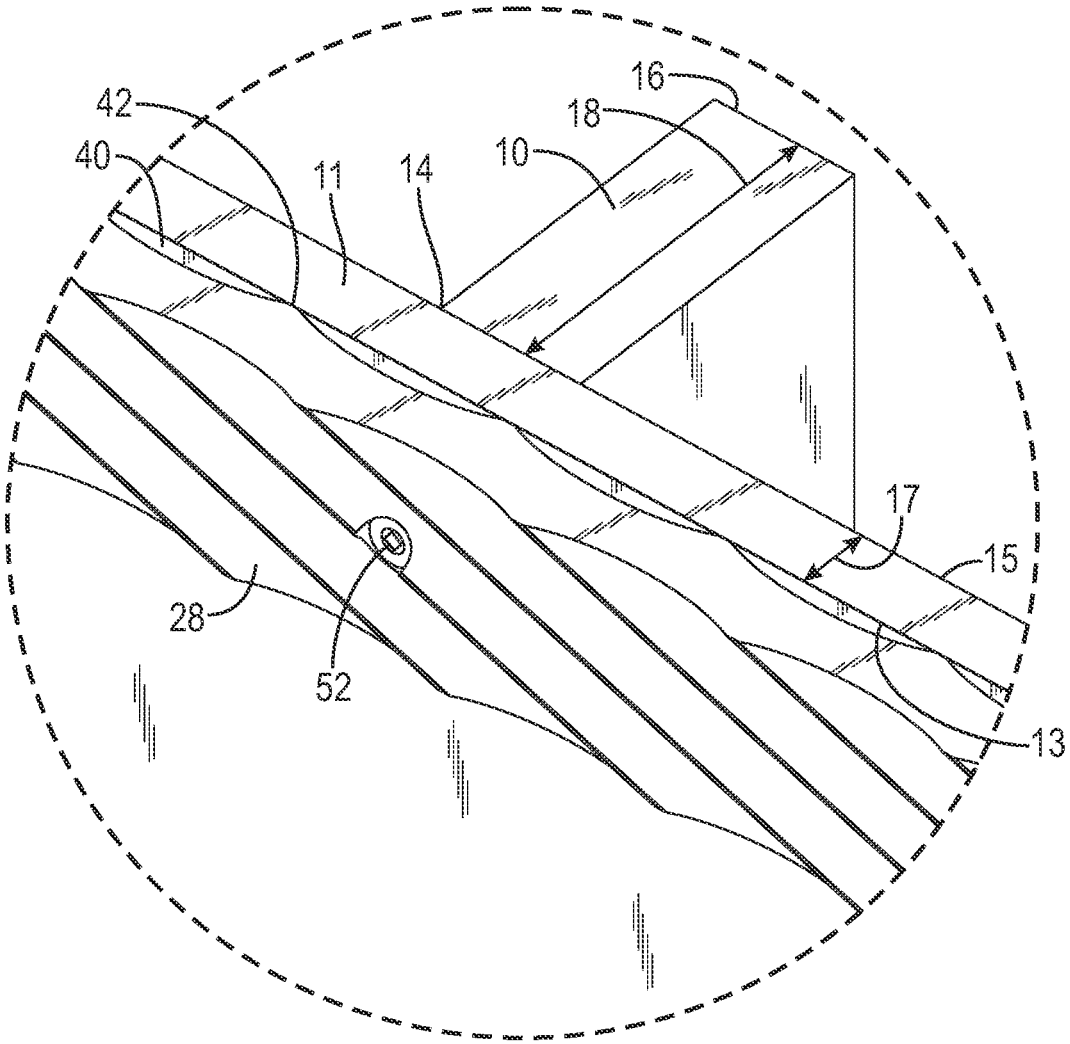
FIG. 12 illustrates a closeup view of the circled area labelled 12 in FIG. 11.
Figure 14:
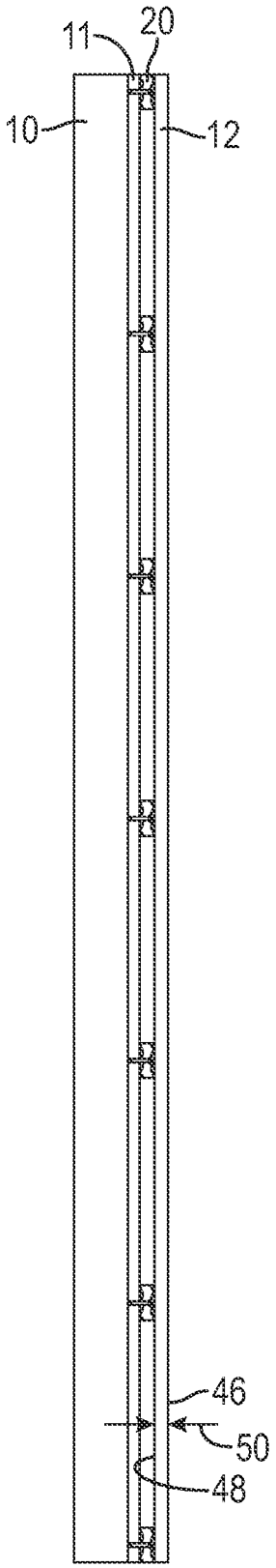
FIG. 14 illustrates a distal end elevation view of the wall of FIG. 10.
Figure 13:
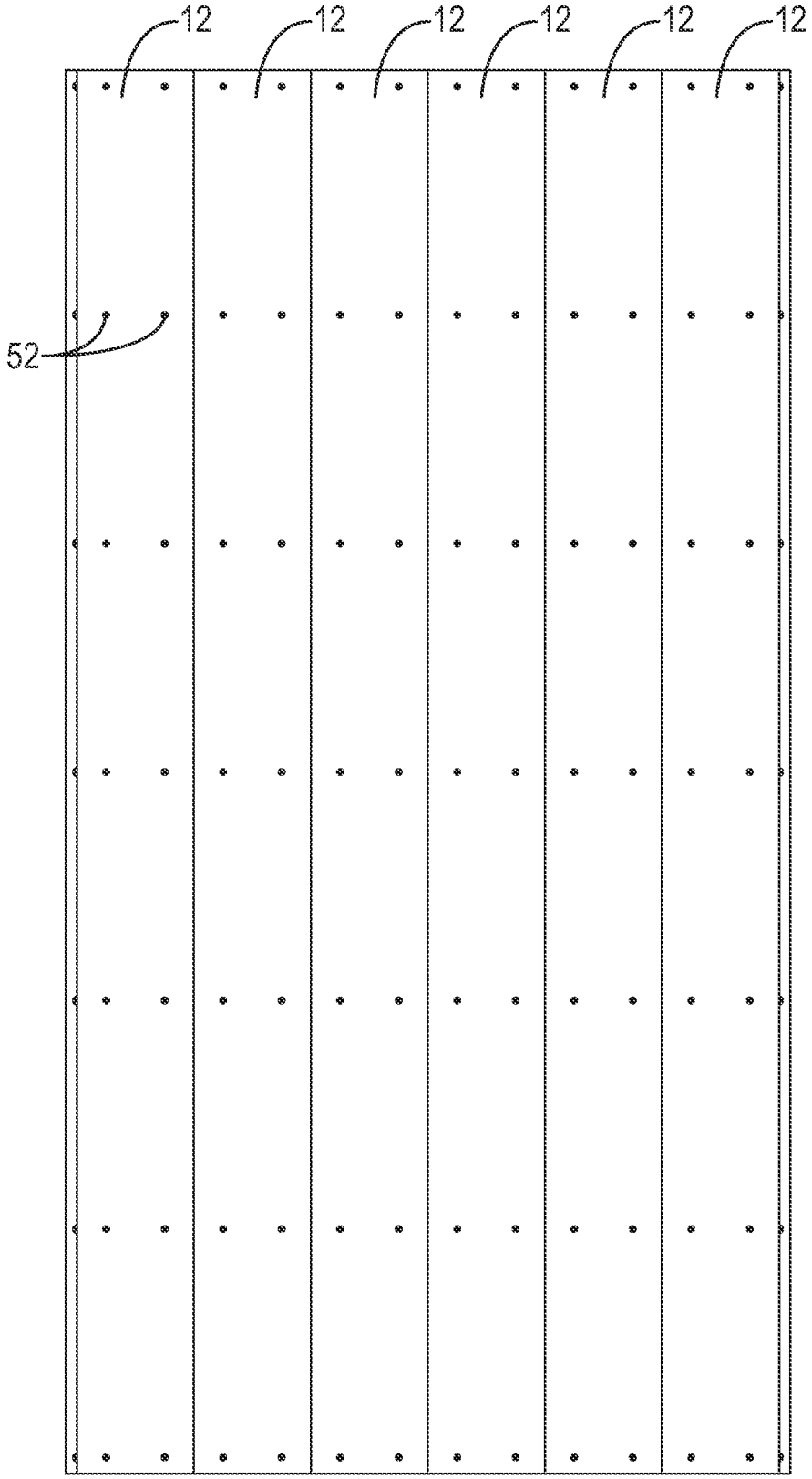
FIG. 13 illustrates a front elevation view of the wall of FIG. 10.
Figure 15A:
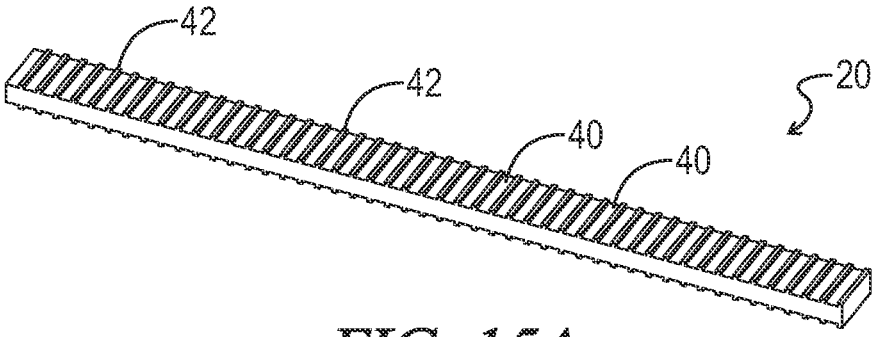
FIG. 15A illustrates a front, first end perspective view of a fluted furring strip in accordance with another embodiment of the present invention.
Figure 15B:
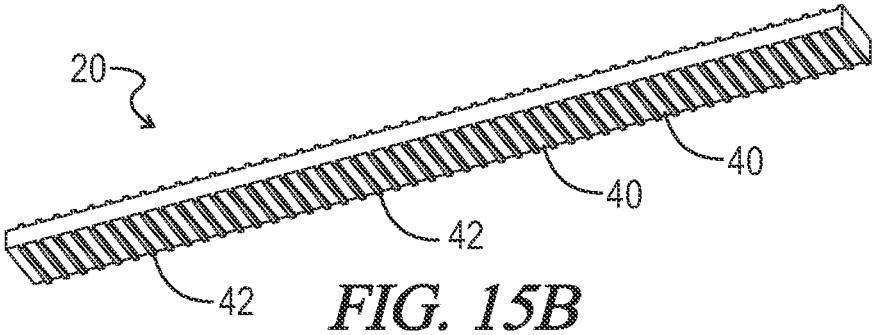
FIG. 15B illustrates a rear, first end perspective view of the fluted furring strip of FIG. 15A.
Figure 15C:
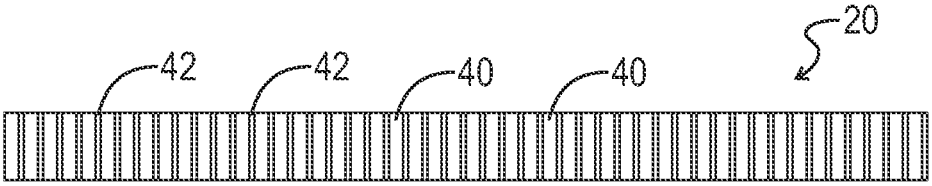
FIG. 15C illustrates a front elevation view of the fluted furring strip of FIG. 15A.
Figure 15D:
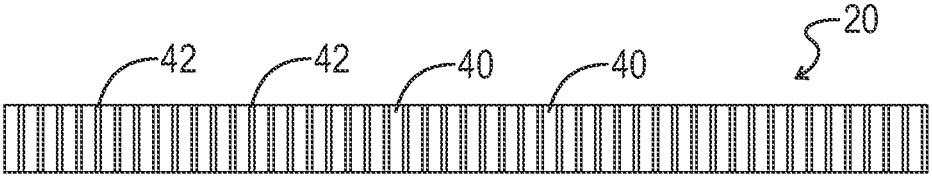
FIG. 15D illustrates a rear elevation view of the fluted furring strip of FIG. 15A.
Figure 16A:
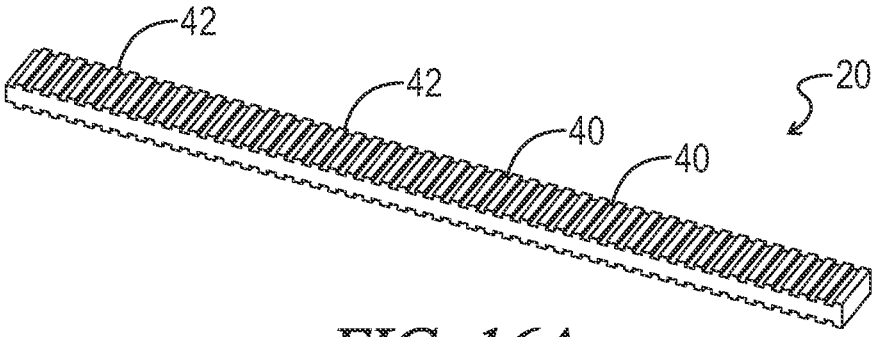
FIG. 16A illustrates a front, first end perspective view of a fluted furring strip in accordance with another embodiment of the present invention.
Figure 16B:
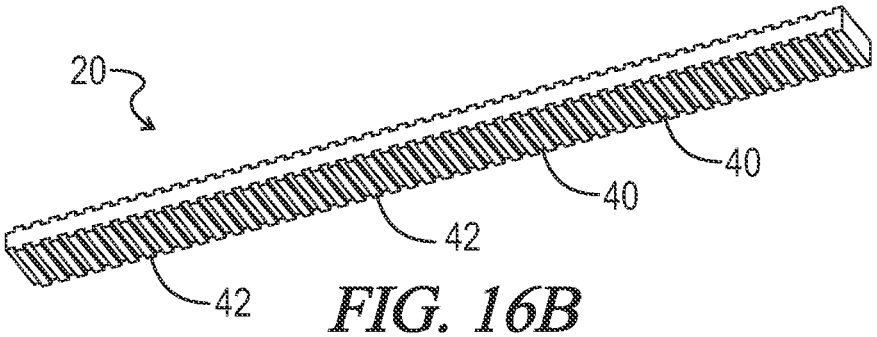
FIG. 16B illustrates a rear, first end perspective view of the fluted furring strip of FIG. 16A.
Figure 16C:
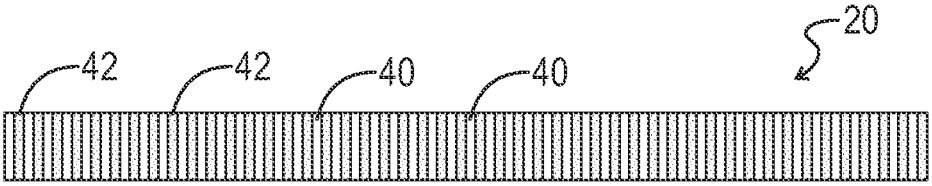
FIG. 16C illustrates a front elevation view of the fluted furring strip of FIG. 16A.
Figure 16D:
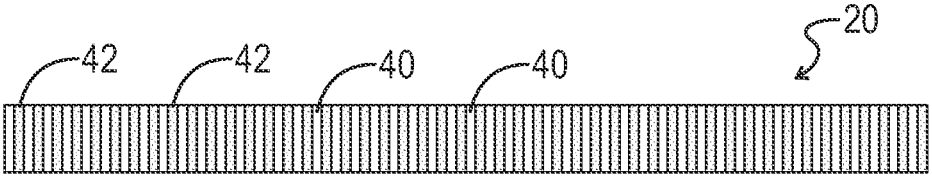
FIG. 16D illustrates a rear elevation view of the fluted furring strip of FIG. 16A.

Optionally, as seen in FIGS. 1 and 1A, the strip proximal end 34 and strip distal end 36 comprise two flat regions 56 separated by a groove 40 extending parallel to the strip thickness 32. Optionally, said groove 40 extending parallel to the strip thickness 32 is concave. Optionally, said groove 40 extending parallel to the strip thickness 32 extends the entire strip width 26. Alternatively, the proximal and distal ends may be entirely flat as shown in FIGS. 15A and 15B. for example.

Optionally, the fastener 52 comprises a screw, bolt, washer, and/or nail. Optionally, the fastener 52 is oriented parallel to the strip thickness 32.

Figure 17A:
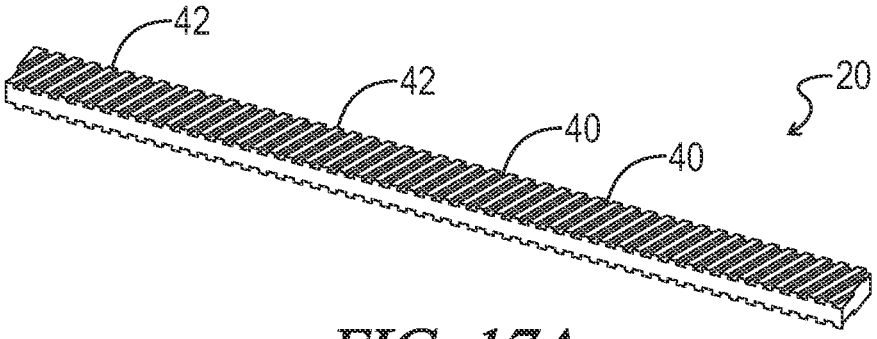
FIG. 17A illustrates a front, first end perspective view of a fluted furring strip in accordance with another embodiment of the present invention.
Figure 17B:
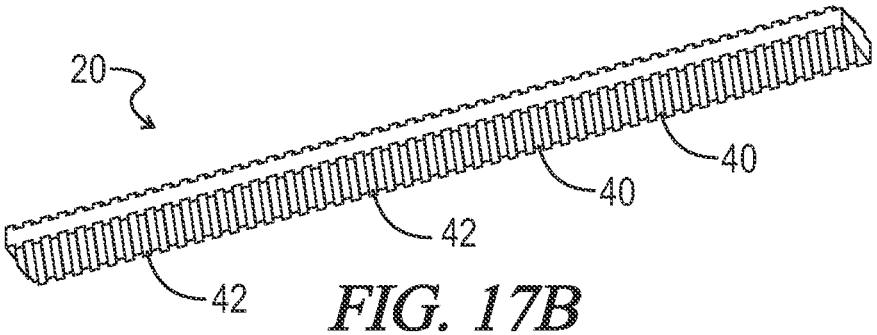
FIG. 17B illustrates a rear, first end perspective view of the fluted furring strip of FIG. 17A.
Figure 17C:
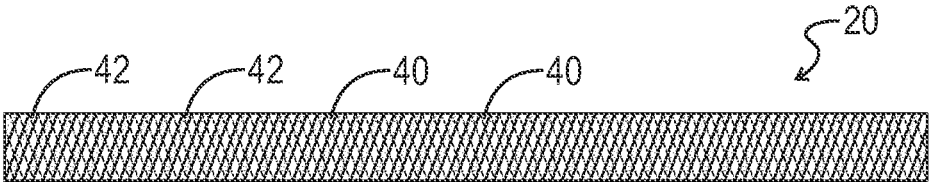
FIG. 17C illustrates a front elevation view of the fluted furring strip of FIG. 17A.
Figure 17D:
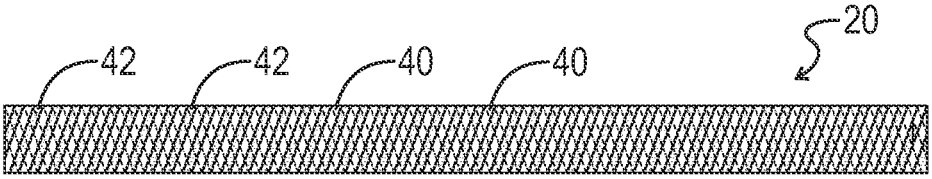
FIG. 17D illustrates a rear elevation view of the fluted furring strip of FIG. 17A.
Figure 18A:
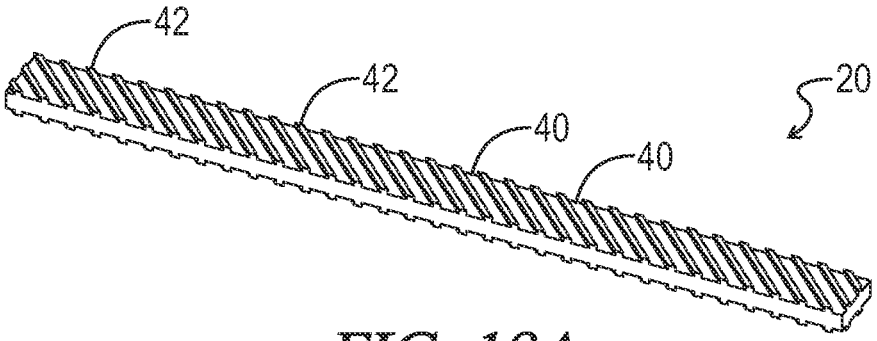
FIG. 18A illustrates a front, first end perspective view of a fluted furring strip in accordance with another embodiment of the present invention.
Figure 18B:
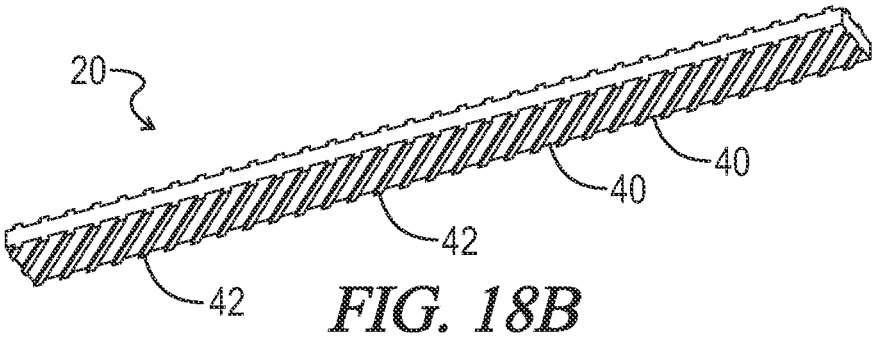
FIG. 18B illustrates a rear, first end perspective view of the fluted furring strip of FIG. 18A.
Figure 18C:
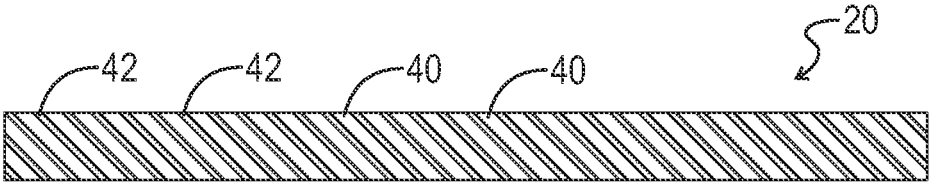
FIG. 18C illustrates a front elevation view of the fluted furring strip of FIG. 18A.
Figure 18D:
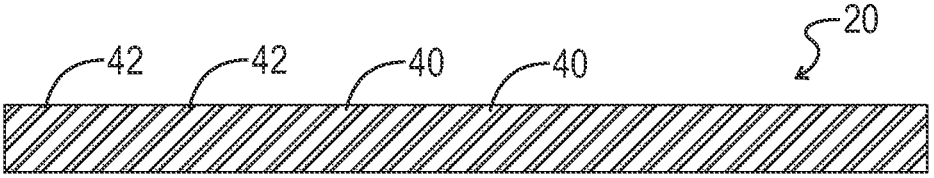
FIG. 18D illustrates a rear elevation view of the fluted furring strip of FIG. 18A.
Figure 19A:
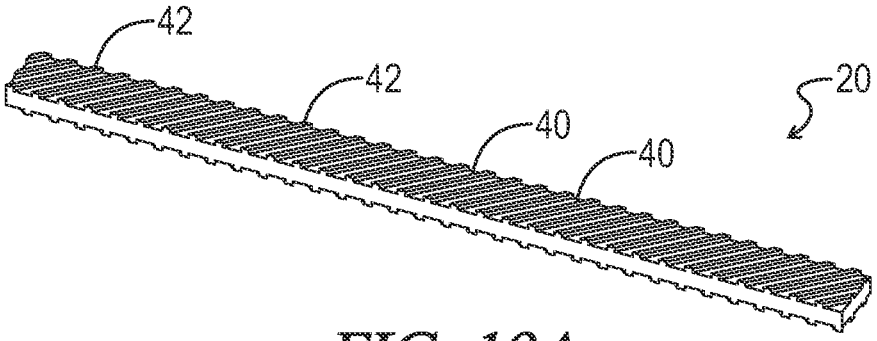
FIG. 19A illustrates a front, first end perspective view of a fluted furring strip in accordance with another embodiment of the present invention.
Figure 19B:
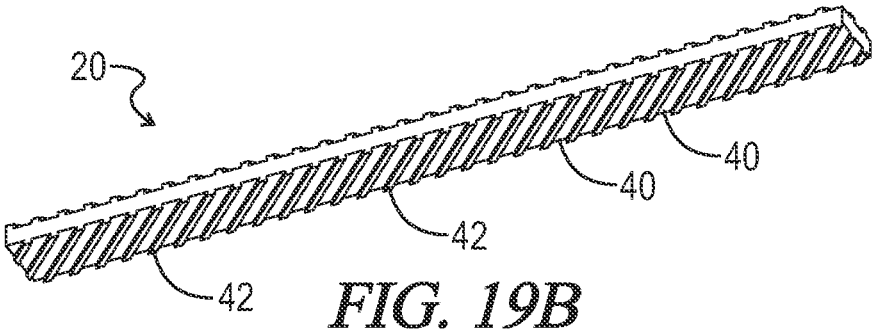
FIG. 19B illustrates a rear, first end perspective view of the fluted furring strip of FIG. 19A.
Figure 19C:
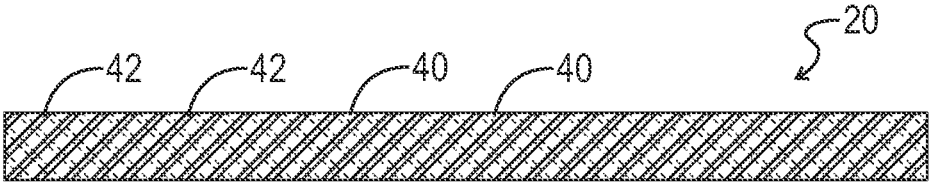
FIG. 19C illustrates a front elevation view of the fluted furring strip of FIG. 19A.
Figure 19D:
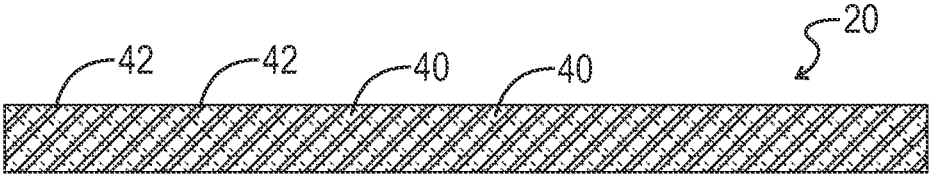
FIG. 19D illustrates a rear elevation view of the fluted furring strip of FIG. 19A.
Figure 20A:
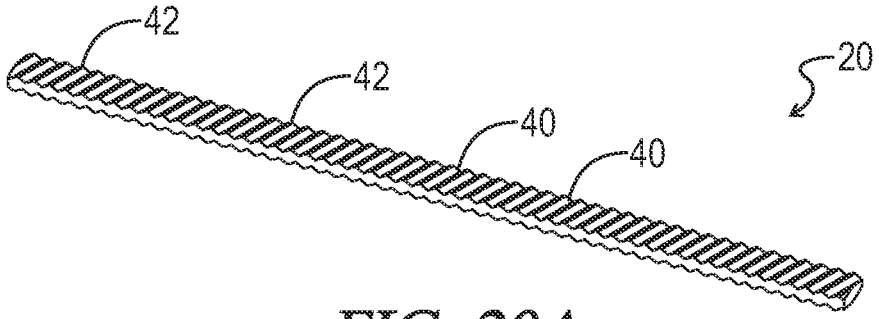
FIG. 20A illustrates a front, first end perspective view of a fluted furring strip in accordance with another embodiment of the present invention.
Figure 20B:
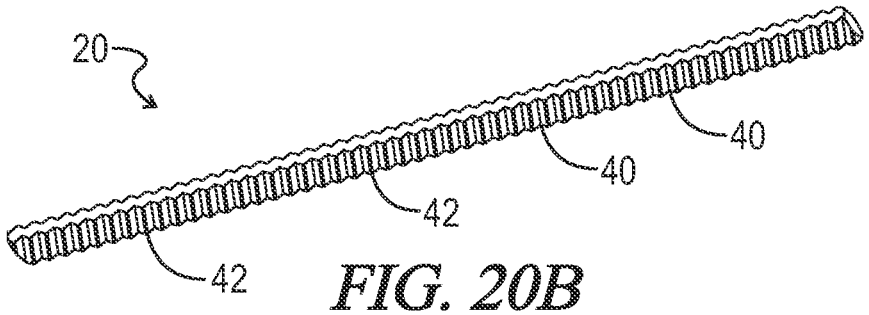
FIG. 20B illustrates a rear, first end perspective view of the fluted furring strip of FIG. 20A.
Figure 20C:
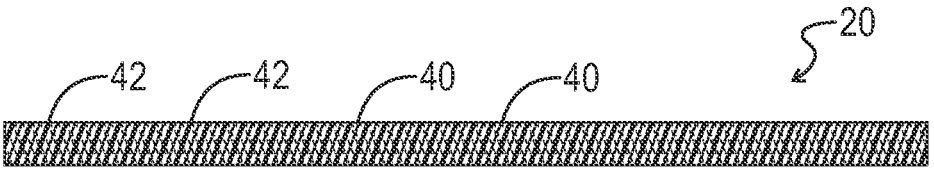
FIG. 20C illustrates a front elevation view of the fluted furring strip of FIG. 20A.
Figure 20D:
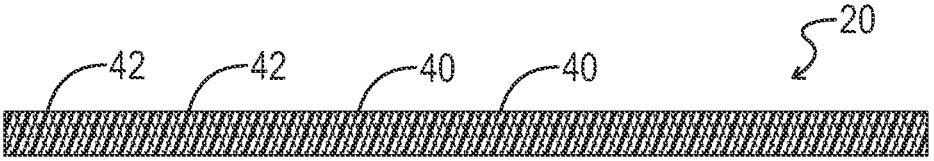
FIG. 20D illustrates a rear elevation view of the fluted furring strip of FIG. 20A.
Figure 21A:
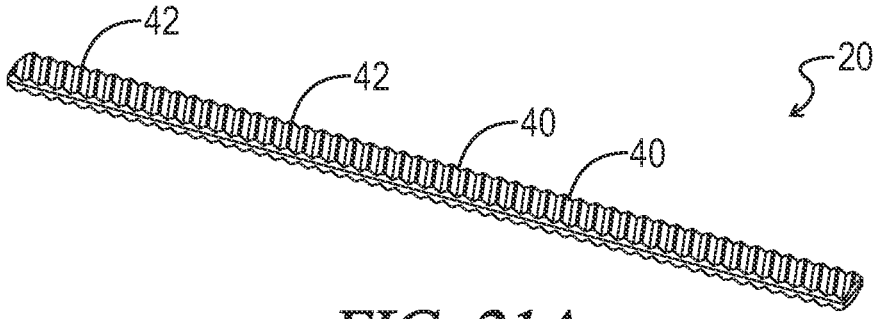
FIG. 21A illustrates a front, first end perspective view of a fluted furring strip in accordance with another embodiment of the present invention.
Figure 21B:
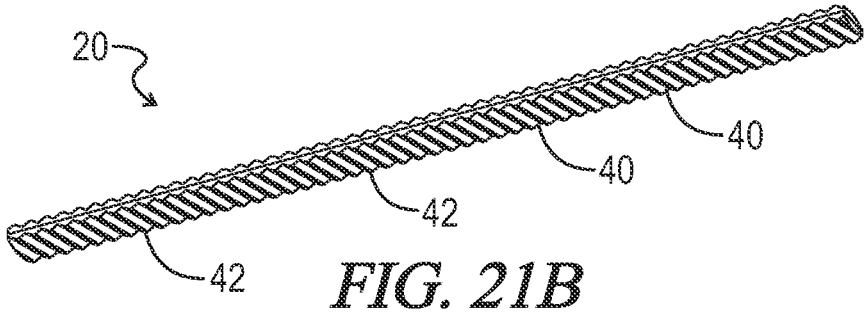
FIG. 21B illustrates a rear, first end perspective view of the fluted furring strip of FIG. 21A.
Figure 21C:
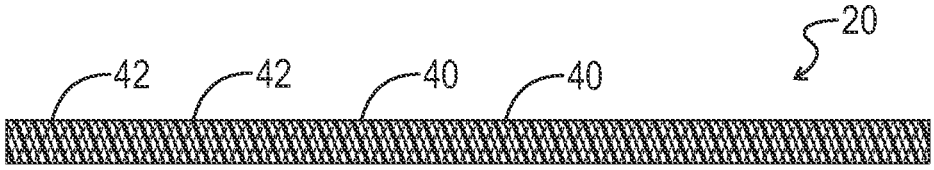
FIG. 21C illustrates a front elevation view of the fluted furring strip of FIG. 21A.
Figure 21D:
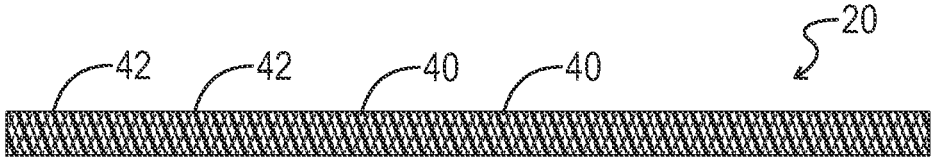
FIG. 21D illustrates a rear elevation view of the fluted furring strip of FIG. 21A.

Optionally, as seen in FIGS. 1-9, each groove 40 is concave in shape. However, any suitable shape may be used. For example, optionally, the grooves 40 are rectangular, as shown in FIGS. 15-19, or triangular such as shown in FIGS. 20-21. Referring further to FIGS. 15-21, FIGS. 15A-15D, 16A-16D, 17A-17D, 18A-18D, 19A-19D, 20A-20D and 21A-21D show various other groove 40 and ridge 42 designs that differ from the design shown in FIGS. 1-9. For example, FIGS. 15A-15D show an embodiment where the grooves 40 and ridges 42 are oriented parallel to the strip width 26 (and perpendicular to the strip length 38). In FIGS. 15A-15D, the grooves 40 on the strip front 28 are aligned and parallel to the grooves 40 on the strip rear 30 and the ridges 42 on the strip front 28 are aligned and parallel to the ridges 42 on the strip rear 30 so that air flows in the same direction on the strip front 28 and strip rear 30. FIGS. 16A-16D show a similar design as FIGS. 15A-15D but with grooves 40 closer together. FIGS. 17A-17D show a design with the grooves 40 on the strip front 28 slightly angled to the strip width 26 and the grooves 40 on the strip rear 30 slightly angled to the strip width 26 in the reverse orientation as compared to the strip front 28 so that air flows in different directions on the strip front 28 and strip rear 30—i.e., the ridges 42 on the strip front 28 would cross the ridges 42 on the strip rear 30 if the ridges 42 were on the same side of the strip 20, as shown in FIGS. 17C and 17D. FIGS. 18A-18D show a design with the grooves 40 angled 45 degrees relative to the strip length 38. FIGS. 19A-19D show a design with the grooves 40 on the strip front 28 angled 45 degrees to the strip length 38 and the grooves 40 on the strip rear 30 angled 45 degrees to the strip length 38 in the reverse orientation as compared to the strip front 28. FIGS. 20A-20D show a design with the grooves 40 on the strip front 28 slightly angled to the strip width 26 and the grooves 40 on the strip rear 30 slightly angled to the strip width 26 in the reverse orientation as compared to the strip front 28. FIGS. 21A-21D show a similar design to FIGS. 20A-20D, except that in FIGS. 21A-21D, the strip front 28 and strip rear 30 are distinct pieces that are attached together.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. It is understood that use of the singular embraces the plural and vice versa. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies. In addition, the steps of the methods described herein can be performed in any suitable order, including simultaneously.

| PART LIST | |
|---|---|
| Substrate | 10 |
| Backing | 11 |
| Panel | 12 |
| Backing front | 13 |
| Substrate front | 14 |
| Backing rear | 15 |
| Substrate rear | 16 |
| Backing thickness | 17 |
| Substrate thickness | 18 |
| Fluted furring strip | 20 |
| Strip first end | 22 |
| Strip second end | 24 |
| Strip width | 26 |
| Strip front | 28 |
| Strip rear | 30 |
| Strip thickness | 32 |
| Strip proximal end | 34 |
| Strip distal end | 36 |
| Strip length | 38 |
| Plurality of grooves | 40 |
| Plurality of ridges | 42 |
| Panel front | 46 |
| Panel rear | 48 |
| Panel thickness | 50 |
| Fastener | 52 |

-continued

| PART LIST | |
|---|---|
| Fastener hole | 54 |
| Flat regions | 56 |
| End groove | 58 |
| Wall | 60 |
| Angle | 62 |

What is claimed is:

1. A method of connecting a substrate to a panel, the method comprising:

a) providing a substrate comprising a substrate front, a substrate rear, and a substrate thickness extending from the substrate front to the substrate rear;

b) providing a fluted furring strip comprising a strip first end, a strip second end, a width extending from the strip first end to the strip second end, a strip front, a strip rear, a strip thickness extending from the strip front to the strip rear and perpendicular to the strip width, a strip proximal end, a strip distal end, and a strip length extending from the strip proximal end to the strip distal end and generally perpendicular to the strip thickness and the strip width, wherein the strip front and/or strip rear comprise a plurality of grooves separated by a plurality of ridges, wherein the strip length is greater than the strip width and strip thickness;

c) providing a panel comprising a panel front, a panel rear, and a panel thickness extending from the panel front to the panel rear; and d) connecting the panel, the fluted furring strip, and the substrate so that the strip front faces the panel rear, and the strip rear faces the substrate front.

2. The method of claim 1 wherein step d) comprises attaching the panel to the fluted furring strip and the fluted furring strip to the substrate using one or more fasteners.

3. The method of claim 2 wherein the fastener is oriented parallel to the strip thickness.

4. The method of claim 1 wherein the method further comprises providing a backing comprising a backing front, a backing rear, and a backing thickness extending from the backing front to the backing rear, wherein step d) comprises connecting the panel, the fluted furring strip, the backing and the substrate so that the strip front faces the panel rear and the strip rear faces the substrate front and the backing front and so that the backing front faces the strip rear and the backing rear faces the substrate front.

5. The method of claim 4 wherein the backing comprises plywood or oriented strand board.

6. The method of claim 5 wherein the substrate, fluted furring strip, and/or panel are comprised of wood.

7. The method of claim 1 wherein the panel comprises a siding or other cladding panel.

8. The method of claim 1 wherein the substrate comprises a post attached directly or indirectly to the ground.

9. The method of claim 1 wherein the substrate comprises a stud, the panel and the stud are oriented perpendicular to the fluted furring strip, and further wherein the stud is oriented perpendicular to the ground and the fluted furring strip is oriented parallel to the ground.

10. The method of claim 1 wherein at least some of the ridges and grooves extend across the entire width of the fluted furring strip.

11. The method of claim 1 wherein the strip front and strip rear comprise said plurality of grooves and said plurality of ridges.

12. The method of claim 11 wherein the strip front and strip rear comprise the same pattern of ridges and grooves.

13. The method of claim 1 wherein each adjacent groove is separated by a ridge.

14. The method of claim 1 wherein each ridge comprises a rounded apex.

15. The method of claim 1 wherein each groove is concave in shape.

16. The method of claim 1 wherein the grooves are spaced approximately evenly apart along the strip length and the ridges are spaced approximately evenly apart along the strip length, wherein each groove is substantially the same size, and further wherein each ridge is substantially the same size.

17. The method of claim 1 wherein the strip front and strip rear comprise said plurality of grooves and said plurality of ridges, wherein each groove on the strip front and strip rear is oriented diagonal to the strip length, wherein the grooves on the strip front are oriented parallel to each other, and further wherein the grooves on the strip rear are oriented parallel to each other.

18. The method of claim 17 wherein the grooves on the strip rear are in a reverse orientation as compared to the grooves on the strip front.

19. The method of claim 17 wherein the grooves on the strip rear are oriented parallel to the grooves on the strip front.

20. The method of claim 1 wherein the strip proximal end and strip distal end comprise two flat regions separated by a groove extending parallel to the strip thickness.

21. The method of claim 20 wherein said groove extending parallel to the strip thickness is concave.

22. The method of claim 20 wherein said groove extending parallel to the strip width extends the entire strip width.

23. The method of claim 1 further comprising flowing air through the grooves.

24. A method of connecting a substrate to siding or other cladding to form a wall, the method comprising:

a) providing a plurality of substrates, each substrate comprising a substrate front, a substrate rear, and a substrate thickness extending from the substrate front to the substrate rear;

b) providing a plurality of fluted furring strips, each fluted furring strip comprising a strip first end, a strip second end, a strip width extending from the strip first end to the strip second end, a strip front, a strip rear, a strip thickness extending from the strip front to the strip rear and perpendicular to the strip width, a strip proximal end, a strip distal end, and a strip length extending from the proximal end to the distal end and generally perpendicular to the strip thickness and strip width, wherein the strip front and/or strip rear comprise a plurality of grooves separated by a plurality of ridges, wherein the strip length is greater than the strip width and strip thickness;

c) providing a plurality of panels, each panel comprising a panel front, a panel rear, and a panel thickness extending from the panel front to the panel rear; and d) connecting the panels, the fluted furring strips, and the substrates, so that, after step d), the wall is comprised of a panel layer comprising the plurality of panels spaced at approximately equal intervals, a strip layer located behind the panel layer and comprising the plurality of fluted furring strips spaced at approximately equal intervals, and a substrate layer located behind the strip layer and comprising the plurality of substrates spaced at approximately equal intervals.

25. The method of claim 24 wherein the strip layer comprises at least four fluted furring strips spaced at approximately equal intervals.

26. The method of claim 24 wherein the panel layer comprises at least four panels spaced no more than 2 inches apart.

27. The method of claim 24 wherein the plurality of substrates comprise a plurality of studs and the substrate layer comprises at least four studs spaced at approximately equal intervals.

28. The method of claim 24 wherein the distance between adjacent panels is less than the distance between adjacent fluted furring strips and adjacent substrates.

29. The method of claim 24 wherein the method comprises providing a backing, wherein the method further comprises connecting the panels, the fluted furring strips, the backing, and the substrates so that, after step d), the wall is comprised of a panel layer comprising the plurality of panels spaced at approximately equal intervals, a strip layer located behind the panel layer and comprising the plurality of fluted furring strips spaced at approximately equal intervals, a backing layer located behind the strip layer and comprising the backing, and a substrate layer located behind the backing layer and comprising the plurality of substrates spaced at approximately equal intervals.

30. The method of claim 24, wherein the panels are oriented vertically or horizontally, the strips are oriented vertically or horizontally, and the substrates are oriented vertically or horizontally.

* * * * *